United States Patent [19]

Litzinger, Jr.

[11] Patent Number: 4,557,281

[45] Date of Patent: Dec. 10, 1985

[54] FILTERED CIGARETTE

[75] Inventor: Elmer F. Litzinger, Jr., Louisville, Ky.

[73] Assignee: Brown & Williamson Tobacco Corporation, Louisville, Ky.

[21] Appl. No.: 558,221

[22] Filed: Dec. 5, 1983

[51] Int. Cl.[4] ..... A24D 3/04

[52] U.S. Cl. ..... 131/336

[58] Field of Search ..... 131/336, 339, 340

[56] References Cited

U.S. PATENT DOCUMENTS 4,135,523 1/1979 Luke et al. ..... 131/336

*Primary Examiner*—V. Millin

*Attorney, Agent, or Firm*—Charles G. Lamb

[57] ABSTRACT

A smoking article, such as a cigarette, includes an air impermeable generally cylindrically shaped plug located in coaxial abutment to one end of the tobacco column of the cigarette and a generally cylindrically shaped filter rod located in coaxial abutment with the plug. The plug is formed with a plurality of grooves in its peripheral surface extending generally longitudinally of the plug from one end to the other end thereof. Air permeable tipping material circumferentially surrounds the impermeable plug and the filter rod, and overlaps a portion of the tobacco column adjacent to plug to fasten the plug and filter rod to the tobacco column.

7 Claims, 5 Drawing Figures

FILTERED CIGARETTE

BACKGROUND OF THE INVENTION

1. Field of the Invention

The present invention relates to smoke diluting devices, and more particularly to a mouthpiece for a cigarette, or the like, which reduces tar almost exclusively by ventilation.

2. Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of the filter which grooves are open to the mouth end of the filter. The filtered smoke leaving the mouth end of the filter is mixed with the ventilation air exiting the ventilation air grooves in the smokers mouth whereat the smoke is diluted. Examples of cigarette filters having grooves for the introduction of ventilating air into the filtering end are shown in the following Patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No. 3,638,661; and U.S. Pat. No. 3,608.561; U.S. Pat. No. 3,910,288; and U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways surrounding and extending parallel to the central passageway, and transverse passageways interconnecting the longitudinal passageways and central passageway with each other and with the ambient air. As the cigarette to which the device is attached is smoked, smoke and ambient air traverses the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 teaches a cigarette with a hollow mouthpiece which defines a smoke chamber. The smoke chamber is separated from the tobacco column by two spaced apart baffle plates which define a curved path which the smoke must transverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straightforward arrangement of an impermeable core and filter for a cigarette for lowering tar primarily by ventilation using ambient air. The present invention also provides for lowering tar primarily by ventilation in conjunction with gas separation.

More particularly, the present invention provides a cigarette comprising a generally cylindrically shaped tobacco column, a generally cylindrically shaped impermeable plug located in coaxial abutment to one end of the tobacco column; a plurality of grooves formed in the periphery of the plug; the grooves extending generally longitudinally of the plug from one end to the other end of the plug; a generally cylindrically shaped filter rod located in coaxial abutment with the plug; and air permeable tipping material circumferentially surrounding the impermeable plug and filter rod, and overlapping a portion of the tobacco column adjacent the plug.

BRIEF DESCRIPTION OF THE DRAWINGS

The various features and advantages of the present invention will become even more clear upon reference to the following description and accompanying drawings wherein like numerals refer to like parts throughout, and in which.

DESCRIPTION OF THE PREFERRED EMBODIMENTS

Figure 1:
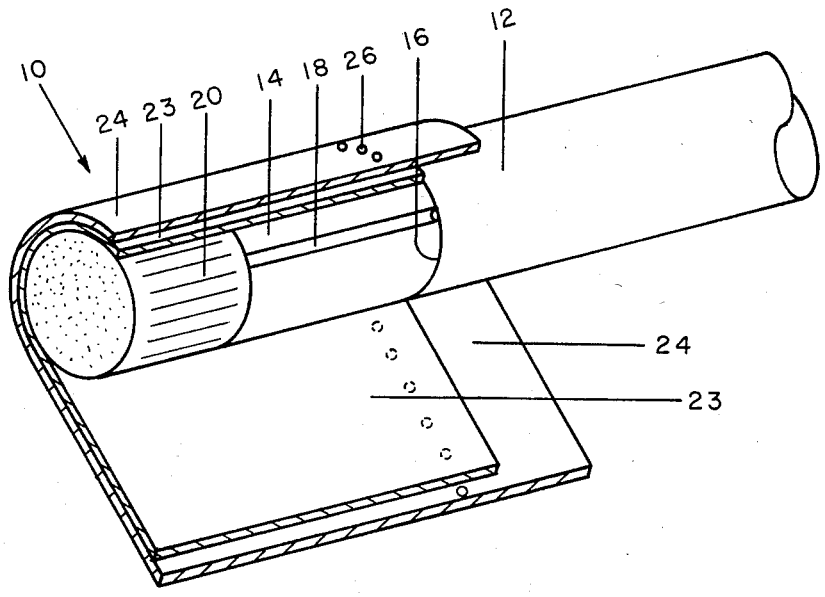
FIG. 1 is a perspective view of a cigarette including one advantageous embodiment of the present invention, the tipping material being illustrated as being partially unwrapped to more clearly show details.
Figure 2:
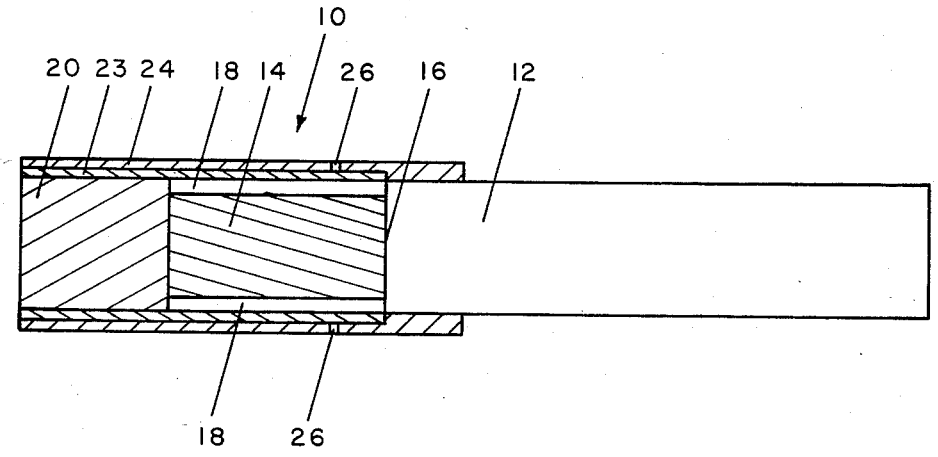
FIG. 2 is a longitudinal cross-sectional view of the cigarette of FIG. 1.

FIGS. 1 through 2 show one advantageous embodiment of the mouthpiece of the present invention, generally denoted as the numeral 10, attached to a cigarette tobacco column 12.

The mouthpiece 10 is illustrated as including a generally cylindrically shaped plug 14 having generally the same diameter as the tobacco column 12 coaxially located at one end 16 of the tobacco column 12 and in juxtaposition thereto. The plug 14 is fabricated of an essentially smoke and air impermeable material such as, for example, closed cell cellulose acetate or blocked fibrous cellulose acetate. The otherwise permeable fibrous cellulose acetate can be blocked to make it essentially impermeable by various suitable additives such as, for example, polyethylene glycol. The impermeable plug 14 is formed with a plurality of grooves 18 in its peripheral surface. The grooves 18 extend, generally longitudinally of the plug 14, from one end to the other end of the plug 14. The grooves 18 are shown as being spaced apart circumferentially of the plug, and are preferably equally spaced apart. Further, the mouthpiece 10 includes a low efficiency filter rod 20 of generally cylindrical configuration having generally the same diameter as the plug 14 coaxially located to the end of the plug 14 opposite the tobacco column 12 and in juxtaposition thereto so that the grooves 18 are in flow communication with the filter rod 20. The filter rod 20 can be fabricated of various materials such as, for example, fibrous or open cell foamed cellulose acetate.

A layer of air permeable wrap 23 circumscribes the filter rod 20 and plug 14 holding the rod 20 and plug 14 together.

The mouthpiece 10 is attached to the tobacco column 12 by means of, for example, tipping material 24 of the type known to the art such as a sheet of paper material. The tipping material 24 circumferentially surrounds the plug 14 and filter rod 20 and overlaps a portion of the tobacco column 12 adjacent to the plug 14. As is well known in the art, the tipping material 24 can be secured to the mouthpiece 10 and tobacco column 12 by an adhesive.

At least a portion of the tipping material 24 surrounding the plug 14 is air permeable to provide for the flow of ambient air into the longitudinal grooves 18 of the plug 14. The tipping material 24 can be fabricated of a porous material or, as shown, the air permeability can be accomplished by forming small air flow perforations 26 through the tipping material 24 to communicate with the longitudinal grooves 18.

As the smoker draws on the cigarette, unfiltered smoke is drawn into the grooves 18 from the end 16 of the tobacco column 12 and ambient air is drawn into the grooves 18 through the perforations in the tipping material 24 and through the permeable wrap 23. The unfiltered smoke and air comingle in the grooves 18 to dilute the smoke. Substantially no smoke flows through the body of the plug 14. The diluted unfiltered smoke passes from the longitudinal grooves 18 through the filter rod 20 and it is discharged into the smoker's mouth.

Figure 3:
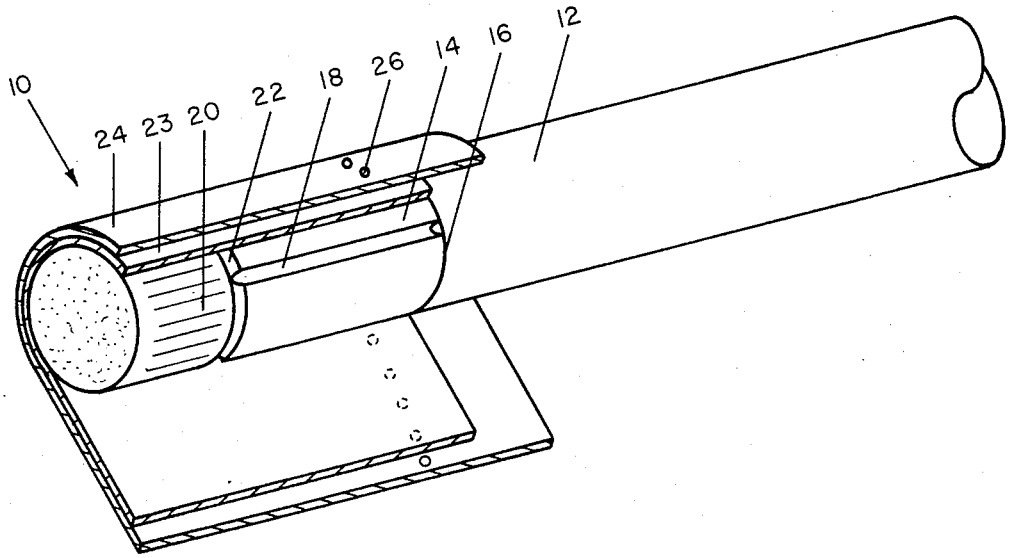
FIG. 3 is a perspective view of a cigarette including another advantageous embodiment of the present invention, the tipping material being illustrated as being partially unwrapped to more clearly show details.
Figure 4:
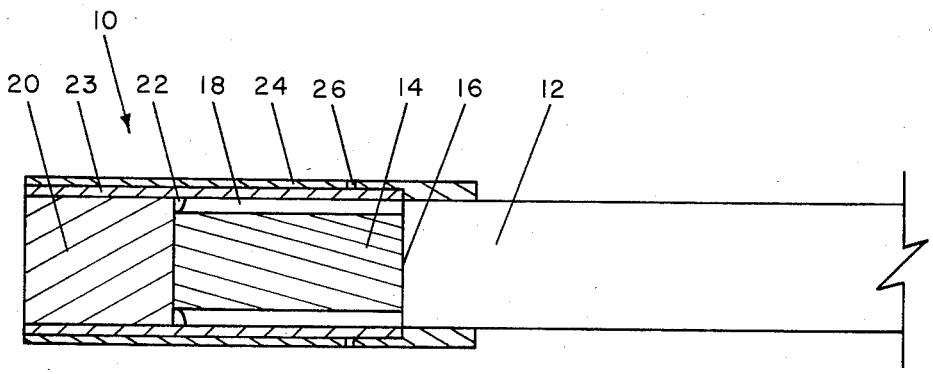
FIG. 4 is a longitudinal cross-sectional view of the cigarette of FIG. 3.
Figure 5:
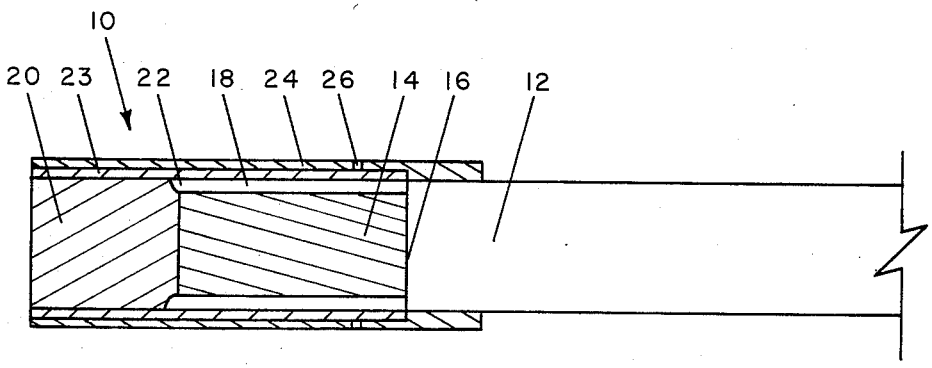
FIG. 5 is a longitudinal cross-sectional view of the cigarette of FIG. 3 as viewed in the same direction as FIG. 4 and showing a modification of the embodiment of FIG. 4.

Now with reference to FIGS. 3–5, the mouthpiece 10 is shown as being formed with an annular groove 22 in communication with all of the longitudinal grooves 18 in the plug 14 and in communication with the filter rod 20. Toward this end, the annular groove 22 can be formed in the peripheral surface of the plug 14 at that end thereof opposite the tobacco column 12 as shown in FIG. 2. The annular groove 22 is open to all of the longitudinal grooves 18 and also open to the end of the plug 14 opposite the tobacco column 12. When the filter rod 20 is coaxially placed against the end of the plug 14, the abutting end of the filter rod 20 overlays the portion of the annular groove 22 open to the end of the plug 14 and is, thus, placed into fluid receiving communication with the annular groove. Alternatively, as can be seen in FIG. 5, an annular groove 22 can be formed in the peripheral surface of the filter rod 20 at and open to the end of the filter rod 20 in coaxial abutment with the plug 14. Thus, the annular groove 22 will be open to all of the longitudinal grooves 18 of the plug 14 and provide for the flow of fluid into the body of the filter rod 20.

As the smoker draws on the cigarette, unfiltered smoke is drawn into the grooves 18 from the end 16 of the tobacco column 12 and ambient air is drawn into the grooves 18 through the perforations in the tipping material 24 and permeable wrap 23.

The unfiltered smoke and air comingle in the grooves 18 to dilute the smoke. Substantially no smoke flows through the body of the plug 14. The diluted unfiltered smoke passes from the longitudinal grooves 18 into the annular groove 22 wherein it is substantially evenly distributed around the perimeter of the plug 14 and the perimeter of the filter rod 20. The diluted unfiltered smoke passes from the annular groove 22 through the filter rod 20 and is therefrom discharged into the smoker's mouth.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. A cigarette comprising:

a generally cylindrically shaped tobacco column;

a generally cylindrically shaped impermeable plug located in coaxial abutment to one end of the tobacco column;

a plurality of grooves formed in the periphery of the plug, the grooves extending generally longitudinally of the plug from one end to the other end of the plug;

a generally cylindrically shaped filter rod located in coaxial abutment with the plug; and, means defining an annular groove at the interface of the impermeable plug and filter rod in flow communication with each of the grooves of the plug and with the filter rod, the annular groove is formed in the filter rod.

2. The cigarette of claim 1, wherein the impermeable plug has a diameter generally equal to the diameter of the tobacco column.

3. The cigarette of claim 2, wherein the filter rod has a diameter generally equal to the diameter of the impermeable plug.

4. The cigarette of claim 1, further comprising permeable wrapper material circumferentially surrounding the impermeable plug and the filter rod, the tipping material overlaying the wrapper material.

5. The cigarette of claim 1, wherein the tipping material is permeable at least in an area overlaying each of the grooves of the plug.

6. The cigarette of claim 1, wherein the tipping material is permeable at least in an area overlaying the filter rod.

7. The cigarette of claim 1, wherein the grooves are generally equally spaced apart circumferentially of the plug.

* * * * *